United States Patent [19]

Johanson

[11] 3,975,599

[45] Aug. 17, 1976

[54] DIRECTIONAL/NON-DIRECTIONAL HEARING AID

[75] Inventor: Donald L. Johanson, Wayland, Mass.

[73] Assignee: United States Surgical Corporation, New York, N.Y.

[22] Filed: Sept. 17, 1975

[21] Appl. No.: 614,069

[52] U.S. Cl. ..... 179/107 FD

[51] Int. Cl.[2] ..... H04R 1/20; H04R 1/34; H04R 25/00

[58] Field of Search ..... 179/107 FD

*Primary Examiner*—George G. Stellar

*Attorney, Agent, or Firm*—Weingarten, Maxham & Schurgin

[57] ABSTRACT

A hearing aid in which the sound reception characteristics are selectable by a user to provide a non-directional or directional reception, as desired. The hearing aid houses a differential transducer having two sound receiving ports communicating with front and rear sound receiving apertures through a network of sound conducting paths. Acoustic switching means are employed to selectably direct sound energy to the transducer through the sound conducting paths, which have equal acoustical impedance in either operating mode, and electric switching means may be associated with the acoustic switching means for adjusting the circuit gain to maintain substantially equal gain for both modes of operation. Frequency characteristics of the hearing aid response in both modes are matched so that switching from one mode to another does not materially alter the quality of sound received from the front of a user.

8 Claims, 6 Drawing Figures

DIRECTIONAL/NON-DIRECTIONAL HEARING AID

FIELD OF THE INVENTION

This invention relates to hearing aids and more particularly to a hearing aid adjustable by a user to selectively provide non-directional or directional receiving characteristics.

BACKGROUND OF THE INVENTION

It is usually desirable that a hearing aid provide good non-directional response to sounds emanating from points to the front, rear and sides of a user. A particularly effective nondirectional hearing aid is described in U.S. Pat. No. 3,201,528, assigned to the assignee of the present invention, wherein both forward facing and rearward facing sound receiving apertures are provided to direct received sound information to a microphone and to provide substantially uniform gain for sounds emanating from various points about the user. In many instances, however, such as in listening to lectures, conversations in a noisy environment, and the like, it would be desirable to enhance the directional characteristics of the hearing aid to accentuate the gain of sounds emanating forwardly of the user. Because of different needs in different listening situations, it is useful to provide a capability of both non-directional and directional characteristics in one hearing aid. A particularly effective selectably directional hearing aid is described in U.S. Pat. Nos. 3,909,556, assigned to the assignee of the present invention.

The invention described in the aforesaid patent attains two modes of operation by selectably occluding the rear aperture of the hearing aid by means of an acoustic valve, but at the same time keeping the rear transducer port energized to avoid undesirable instability. The valve is disposed in a network of sound passages connecting the front and rear sound receiving apertures to first and second input ports of a differential transducer. An acoustic filter in the second transducer port path is used to match the frequency and phase characteristics of the hearing aid response in the two modes so that switching from one mode to another does not materially alter the quality of sound reception. Hearing aids of this type have been found to be very useful. However, under certain operating conditions, especially in a high frequency sound environment, it has been found that the transducer can ring or otherwise become unstable.

SUMMARY OF THE INVENTION

In accordance with the present invention, a selectably directional hearing aid is provided which can be operated even at high gain levels without undesirable instability and which can be switched from the directional to the non-directional mode without materially altering the quality of sound received from the front of a user. Frequency response characteristics of the two modes are matched by maintaining the acoustical impedance of the sound receving paths equal in each mode of operation and by adjusting the gain of the electrical circuitry associated with the transducer to maintain substantially equal gain for both modes of operation. An acoustic control valve is employed to suitably direct sound energy to the hearing aid transducer through sound conducting paths which have equal acoustical impedance in both operating modes.

An electric switch, which may be incorporated into the acoustic switch, is employed either to boost the gain of the lower amplitude non-directional mode response or to attenuate the gain of the higher amplitude directional mode response.

The present invention employs a differential transducer disposed inside a housing adapted to be worn by the user. The transducer has two sound receiving ports communicating through a network of sound conducting paths in the housing. The differential transducer is operative to convert sound information into an electrical output signal which is amplified and processed through associated electrical circuitry. An acoustic valve is provided in the sound conducting paths, such that one port of the transducer may be switched from one of the front to one of the rear apertures to change the operating mode of the hearing aid.

For example, when the valve is in the directional mode position, sound entering a front aperture is channeled to the first transducer port, while sound entering a rear aperture is channeled to the second transducer port. Sound emanating from points to the rear of the user tend to be canceled or substantially reduced in amplitude by operation of the differential transducer, with the result that the hearing aid is most sensitive to sound emanating from points forward of the user so that a directional sound response is provided. With the valve in the non-directional position, sound entering from a first rear aperture is channeled directly to the first transducer port and sound entering a second rear aperture is channeled directly to the second transducer port. Switching the first transducer port from the front aperture in the directional mode to a first rear aperture during the non-directional mode adjusts the sound energy received at the transducer ports in the non-directional mode to eliminate rear cancellation. The acoustical impedance of the sound conducting paths to the transducer ports is substantially the same for both modes of operation.

An electrical switch, which may be incorporated into the acoustic switch, is electrically connected to the circuitry associated with the transducer to permit adjustment of the gain thereof to maintain substantially equal gain for both modes of operation. By maintaining uniform acoustic impedance for the sound receiving paths and uniform gain for the electrical circuitry, the frequency characteristics of the hearing aid non-directional mode response may be matched to approximate the directional mode frontal response, and undesirable instabilities will be eliminated. Thus, the hearing aid of the present invention will operate well even at high gain levels even in the high frequency range and can be switched from non-directional to the directional mode without materially altering the relative quality of sound received from the front of the user.

DESCRIPTION OF THE DRAWINGS

The invention will be more fully understood from the following detailed description taken in conjunction with the accompanying drawings in which.

DETAILED DESCRIPTION OF THE INVENTION

Figure 1:
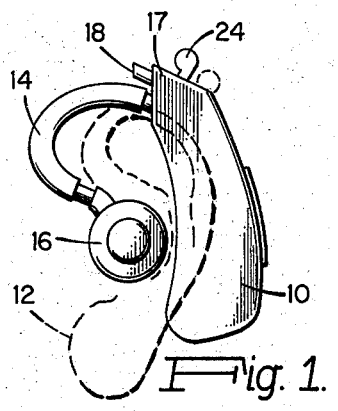
FIG. 1 is a perspective view of a behind-the-rear type of hearing aid embodying the invention.

The invention as embodied in a behind-the-ear type of hearing aid is shown in FIG. 1 and includes a housing 10 adapted and configured to be worn on the ear 12 of a user and coupled by a length of tubing 14 to an earpiece 16 worn in the user's ear. Included within housing 10 is a transducer for converting received sound energy into corresponding electrical energy, amplifying and processing circuitry, a battery source, volume and other controls and a receiver for transducing the amplified electrical signals into acoustical energy for conveyance via tubing 14 to the earpiece 16. Alternatively, the earpiece can include the receiver which is electrically energized via interconnecting wires from the aid circuitry.

Figure 2:
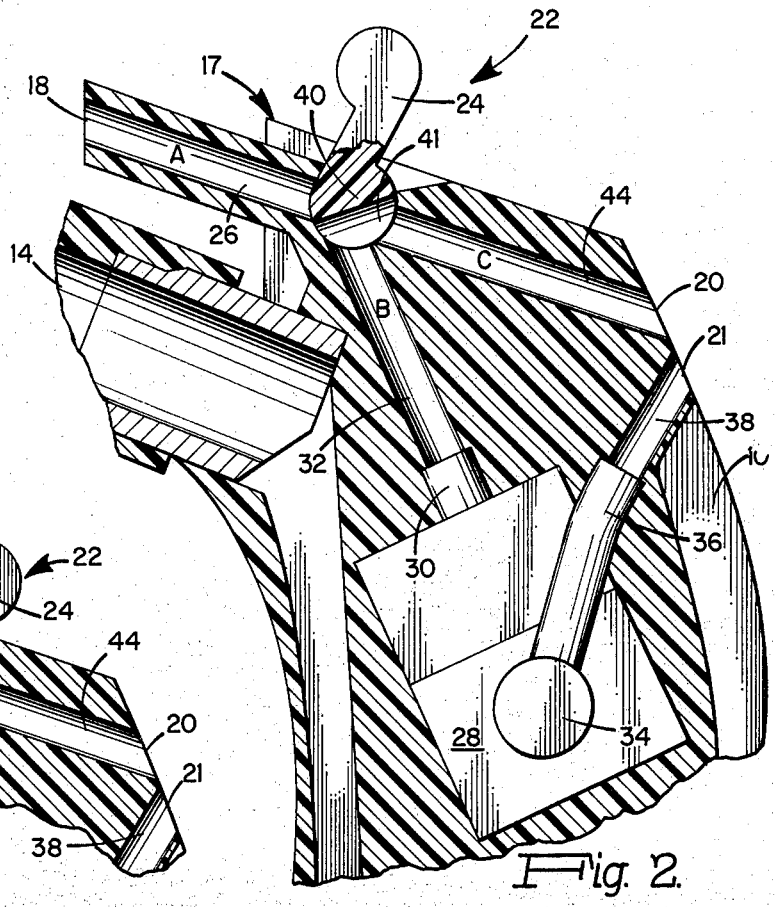
FIG. 2 is an enlarged elevation view of the embodiment of FIG. 1.

The housing 10 includes an upper portion 17 which extends above the ear of a user and which contains a single forwardly facing aperture 18 which is positioned to receive sounds emanating from points forwardly of the user. Two rearwardly facing apertures 20 and 21, visible in FIG. 2, are also provided in the rear surface of upper portion 17 of housing 10 to receive sounds from points rearwardly of the user. A manually adjustable control valve 22, having a control knob 24, is provided in the upper housing portion and is operative according to the invention to alter the directional response characteristics of the hearing aid.

Referring to FIG. 2, it is seen that frontwardly facing aperture 18 communicates with valve 22 via a longitudinal passage 26 provided in the top portion of housing 10. Passage 44 extends from the valve 22 to the rear aperture 20. These passages 26 and 44 respectively forward and aft of valve 22 are substantially equal in length and cross sectional area. A differential transducer 28 is contained within housing 10 and has a first port 30 coupled through a sound communication passage 32 to valve 22. A second port 34 of transducer 28 is coupled via a tube 36 to a passage 38 which extends to rear aperture 21 at a position adjacent to rear aperture 20.

The control valve 22 includes a cylinder 40 disposed within a cylindrical recess formed transversely across housing 10 and in which cylinder 40 is rotatable by action of a manual force applied to control knob 24.

Figure 3:
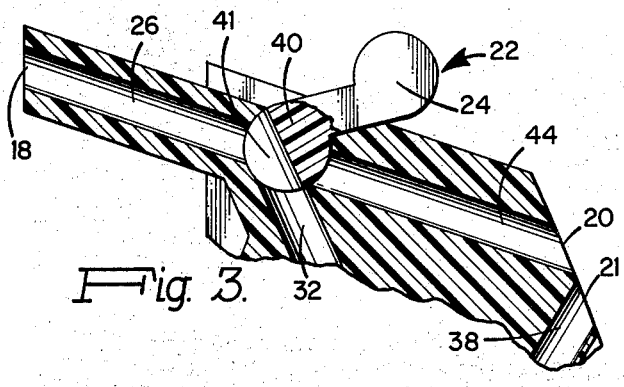
FIG. 3 is a partly cutaway enlarged elevation view of a portion of the structure of FIG. 2 with the control valve in a position opposite to that of FIG. 2.

An opening 41 is provided through cylinder 40, and in one position, depicted in FIG. 2, provides a sound communication path from rear aperture 20 through the valve into passage 32, to the first port 30 of transducer 28. Passage 26 is occluded by the solid portion of cylinder 40 and the front aperture 18 is isolated from the transducer. With the valve 22 rotated to its second position, as depicted in FIG. 3, a sound communication path is provided from the front aperture 18 through passage 26 to valve 22 and through passage 32 to the first transducer port 30. Passage 44 in this mode is occluded and aperture 20 is isolated from the first port 30. In both modes, rear aperture 21 communicates with transducer port 34 through passage 38 and tube 36.

The transducer 28 is of the differential type in which sound energy entering the second port 34 is subtracted from energy entering the first port 30, such that the transducer is responsive to the difference in received energy to provide a corresponding electrical output signal. Such transducers, also known as unidirectional microphones, are per se well known in the art, a typical example being the directional microphone manufactured by Knowles Engineering, Inc., Model BL-1687. Such a differential transducer is also described in U.S. Pat. No. 3,770,911.

With the control valve in the position illustrated in FIG. 3, sounds emanating from points rearwardly of a user enter the hearing aid via aperture 21 and thence via passage 38 and tube 36 to port 34. The transducer 28 and associated valve system is operative to substantially cancel the effects of energy emanating from the rear of aperture 21 and to provide an output signal which is essentially representative of energy received by aperture 18 and resulting from sounds forwardly of a user. The hearing aid in this mode of operation is therefore directional and provides enhanced reception for sounds in front of the user.

With control valve 22 in the position depicted in FIG. 2, the hearing aid is in the non-directional mode. The port 34 of transducer 28 communicates with aperture 21 through passage 38 and tube 36. Port 30 of transducer 28 communicates with aperture 20 through passages 44 and 32. Thus, for non-directional operation, the front aperture 18 is occluded and the rear aperture 20 is coupled to port 30 of transducer 28. The rear port not being in the switch path is always open to received sound and the opportunity for transducer instability is avoided or substantially minimized.

The directional receiving pattern of the hearing aid is essentially cardioid in shape, as is usual for directional microphones, and the particular pattern can be varied as desired by adjusting the distance between apertures 18 and 21 to effectively vary the resulting pressure pattern on transducer ports 30 and 34. To achieve non-directionality, the ports are switched such that there is essentially no distance between the aperture 20 leading to port 30 and the aperture 21 leading to port 34. The cross sectional area and length of passages 26 and 44 are selected to provide equal acoustic impedance for the sound paths in each mode of operation. Thus, the combined acoustic impedance of passages 26 and 32 in the directional mode equals that of passages 44 and 32 in the non-directional mode. Further, the acoustic impedance of passage 38, intermediate rear aperture 21 and transducer port 34, may be made to substantially match the combined acoustic impedance of paths 26 and 32, which as already stated is the same as paths 44 and 32.

Figure 4:
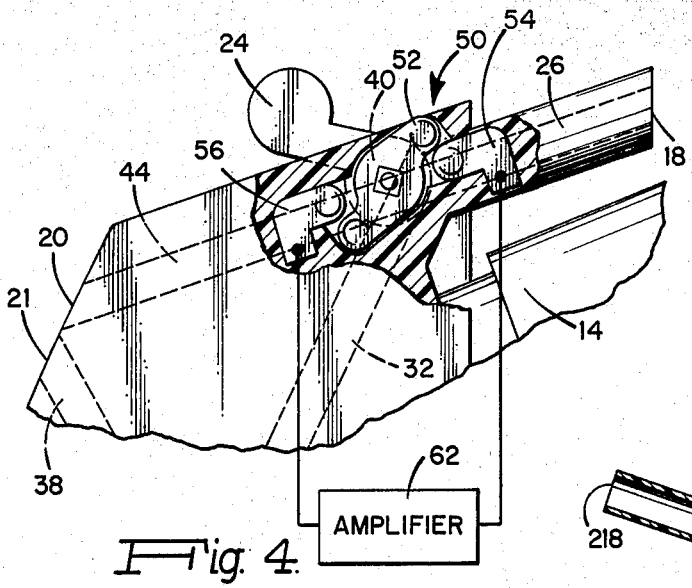
FIG. 4 is a partly cutaway enlarged elevation view of a portion of the structure of FIG. 2 showing the electrical switch and its associated circuitry which is combined with the acoustical control valve.

In the embodiment of the invention shown in FIG. 4, an electrical switch 50 is incorporated into the acoustic valve 22. An electrically conductive switch arm 52 is affixed to one end of rotatable cylinder 40 of acoustic valve 22 by any suitable means and is rotatable with cylinder 40. Electricaly conductive contacts 54 and 56 are disposed in housing 10 and are engaged by switch arm 52 in one of its two operating positions. Contacts 54 and 56 are electrically connected to the electrical circuitry, typically the amplifier 62, associated with the hearing aid for receiving and processing the output of transducer 28. The electric switch operates to maintain the gain of amplifier 62 substantially equal for both modes of operation. The switch may be used to boost the gain of the lower amplitude non-directional mode response or to attenuate the gain of the higher amplitude directional mode response.

It is within the contemplation of the present invention that the electrical switch 50 may be separately mounted and separately operable rather than being combined with the acoustic valve 22. In accordance with the invention, it can be seen that undesirable instability is avoided by maintaining the acoustical impedance of the sound receiving paths equal for each mode of operation and by adjusting the gain of the electrical circuitry associated with the transducer to maintain equal gain for both modes of operation. The frequency and gain characteristics of the non-directional response may thus be matched to approximate the frequency and gain characteristics of the directional frontal response so that switching the hearing aid from one mode to the other does not materially alter the quality of received sound from the front. If the variation in gain levels for the two modes of operation is within tolerable range, electrical switching need not be employed; in this event, the acoustic switching is also employed to provide enhanced dual mode performance.

Figure 5A:
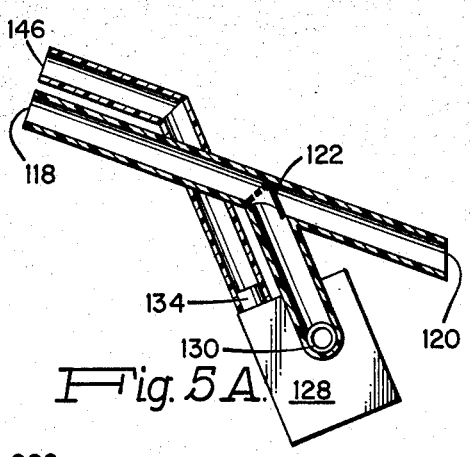
FIGS. 5A and 5B are diagrammatic representations of alternative embodiments of the hearing aid shown in FIG. 2.
Figure 5B:
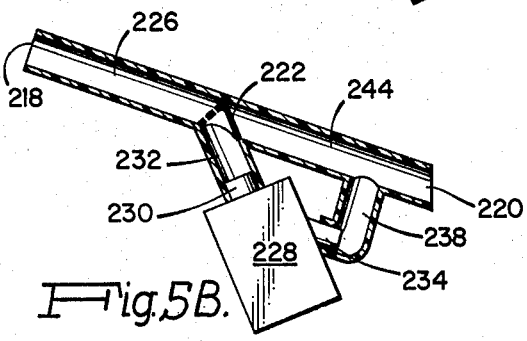

Referring now to FIGS. 5A and 5B, there are shown diagrammatic representations of alternative embodiments of the invention. In FIG. 5A, there is shown a hearing aid employing two front sound receiving apertures 118 and 146 and a single rear aperture 120. A control valve 122, such as in FIGS. 2–4, is to selectably connect either aperture 118 or 120 to the first input port 130 of transducer 128, while front aperture 146 is always connected to the second input port 134. In FIG. 5B, there is shown a further alternative embodiment employing a single front aperture 218 and a single rear aperture 220. A control valve 222 provides selectable coupling of apertures 218 and 220 to second port 230 of transducer 228. Rear aperture 220 is in constant communication with first transducer port 234. Selectable directional and non-directional operation is provided similarly as with the embodiment described above.

It will be appreciated that the invention can be implemented in different ways to suit particular operation requirements. For example, the acoustic control valve and the electric switch can be of many different configurations to provide the intended function, and the particular sound communication paths between the front and rear apertures for coupling forward and rearward sounds to the differential transducer can be selected to suit specific constructional requirements of a particular embodiment. Furthermore, the present invention may also be embodied in hearing aids other than behind-the-ear types; for example, the invention can be implemented in an eyeglass type of aid wherein the hearing aid is incorporated into the bow or temple of the eyeglass frame. Accordingly, it is not intended to limit the invention by what has been particularly shown and described except as indicated in the accompanying claims.

What is claimed is:

1. A hearing aid comprising:

a differential transducer having first and second sound receiving ports;

a housing having at least one forwardly facing sound receiving aperture and at least one rearwardly facing sound receiving aperture;

a first sound receiving path between said rearward facing aperture and said second transducer port;

a second sound receiving path for selectably coupling said first receiving port to said forwardly or said rearwardly facing sound receiving apertures and including:

control valve means operative in a first position to couple sound energy received by said forwardly facing aperture to said first sound receiving port, and in a second position to couple sound energy received by said rearwardly facing aperture to said first sound receiving port;

electronic circuitry for amplifying and processing sound information received by said transducer;

electrical switch means for adjusting the gain of said electronic circuitry to provide substantially the same gain for both modes of operation of said transducer; and an earpiece coupled to said circuitry and adapted to the ear of a user.

2. A hearing aid according to claim 1 wherein:

said at least one rearwardly facing aperture includes first and second rearward facing apertures;

said first sound receiving path includes a first passage between said second rearwardly facing aperture and said second transducer port; and said second sound receiving path includes a second passage between said forwardly facing aperture and said valve means, a third passage between said valve means and said first transducer port and a fourth passage between said first rearwardly facing aperture and said valve means;

said valve means being operative in its first position to provide a sound receiving path through said second and third passages, and operative in its second position to provide a sound receiving path through said third and fourth passages;

the combined acoustic impedance of said second and third passages substantially matching that of said third and fourth passages.

3. A hearing aid according to claim 2 wherein said valve means includes:

a rotatable member disposed at the juncture of said second, third and fourth passages and having an opening therethrough for coupling said third and fourth passages in said first second position. and for coupling said second and third passages in said first position; and a manually actuable control knob attached to said rotatable member and operative to rotate said member between said first and second positions.

4. The hearing aid according to claim 1 wherein said electrical switch means includes:

an electrically conductive switch arm mounted on said control valve means;

electrically conductive contacts disposed in said housing; and means connected to said contacts for varying the gain of said circuitry.

5. The hearing aid according to claim 1 wherein said second sound receiving path includes a first passage between said rearwardly facing aperture and said valve and a third passage between forwardly facing aperture and said valve and a fourth passage between said valve and said first transducer port;

said first path includes a second passage between a second of said at least one rearwardly facing apertures and said second transducer port;

said valve means being operative in its first position to provide a sound receiving path through said third and fourth passages, and operative in its second position to provide a sound receiving path through said first and fourth passages;

the combined acoustic impedance of said third and fourth passages substantially matching that of said first path and the combined acoustic impedance of said first and fourth passages substantially matching that of said first path.

6. A hearing aid comprising;

a differential transducer having first and second sound receiving ports;

a housing having at least one first facing sound receiving aperture facing in one direction and at least one second sound receiving aperture facing in an opposite direction;

a sound receiving path between said second aperture and said second transducer port;

a sound receiving path for selectably coupling said first receiving port to said first or said second sound receiving apertures and including:

control valve means operative in a first position to couple sound energy received by said first facing aperture to said first sound receiving port, and in a second position to couple sound energy received by said second facing aperture to said first sound receiving port;

electronic circuitry for amplifying and processing sound information received by said transducer;

electrical switch means integral with said valve means for adjusting the gain of said electronic circuitry to provide substantially the same gain for both modes of operation of said transducer; and an earpiece coupled to said circuitry and adapted to the ear of a user.

7. A hearing aid comprising:

a differential transducer having first and second sound receiving ports;

a housing having at least one forwardly facing sound receiving aperture and at least two rearwardly facing sound receiving apertures;

a first sound receiving path between a second of said at least two rearwardly facing apertures and said second transducer port;

a second sound receiving path for selectably coupling said first receiving port to said forwardly or to a first of said at least two rearwardly facing sound receiving apertures including a first passage between said first rearwardly facing aperture and said valve means and a second passage between said forwardly facing aperture and said valve means and a third passage between said valve means and said first transducer port;

said valve means being operative in its first position to provide a sound receiving path through said first and third passages and operative in its second position to provide a sound receiving path through said second and third passages;

the combined acoustic impedance of said first and third passages substantially matching that of said second and third passages;

electronic circuitry for amplifying and processing sound information received by said transducer; and an earpiece coupled to said circuitry and adapted to the ear of a user.

8. A hearing aid according to claim 7 further including electrical switch means for adjusting the gain fo said electronic circuitry to provide substantially the same gain for both modes of operation of said transducer.

* * * * *

UNITED STATES PATENT AND TRADEMARK OFFICE

CERTIFICATE OF CORRECTION

PATENT NO. : 3,975,599

DATED : August 17, 1976

INVENTOR(S) : Donald L. Johanson

It is certified that error appears in the above–identified patent and that said Letters Patent are hereby corrected as shown below:

Column 8, after line 5 insert --valve means;--.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*